US011708250B2

(12) United States Patent
Every et al.

(10) Patent No.: US 11,708,250 B2
(45) Date of Patent: Jul. 25, 2023

(54) RETENTION SYSTEM FOR A LINE ON A SPOOL

(71) Applicant: Caterpillar Inc., Peoria, IL (US)

(72) Inventors: Joseph Jeffery Every, Peoria, IL (US); Theran Douglas Frederick, Tucson, AZ (US); Mozamel Elkurdi, Tucson, AZ (US); Michael W. Haws, Tucson, AZ (US)

(73) Assignee: Caterpillar Inc., Peoria, IL (US)

( * ) Notice: Subject to any disclaimer, the term of this patent is extended or adjusted under 35 U.S.C. 154(b) by 288 days.

(21) Appl. No.: 16/749,542

(22) Filed: Jan. 22, 2020

(65) Prior Publication Data

US 2021/0221660 A1 Jul. 22, 2021

(51) Int. Cl.
*B66D 1/34* (2006.01)
*E02F 3/407* (2006.01)

(52) U.S. Cl.
CPC ..... *B66D 1/34* (2013.01); *E02F 3/4075* (2013.01)

(58) Field of Classification Search
CPC . E02F 3/4075; B66D 1/34; B66D 1/30; Y10S 242/903; B65H 75/28; B65H 75/285
See application file for complete search history.

(56) References Cited

U.S. PATENT DOCUMENTS 1,437,987 A * 12/1922 Miller ..... B66D 1/34 242/587.1
1,913,508 A * 6/1933 Phillips ..... B66D 1/34 242/587.1
2,053,976 A * 9/1936 Stahl ..... B66D 1/34 254/375
2,267,335 A * 12/1941 Kiessling ..... B65H 75/285 206/53
2,301,392 A * 11/1942 Funke ..... B65H 75/285 206/53
2,329,943 A * 9/1943 Robins ..... B66D 1/34 242/587.1

(Continued)

FOREIGN PATENT DOCUMENTS

CN 104925591 9/2015
JP 07-026299 6/1995

(Continued)

OTHER PUBLICATIONS

Written Opinion and International Search Report for International Patent Appln. No. PCT/US2021/014070, dated May 6, 2021 (11 pgs).

*Primary Examiner* — Sang K Kim

(57) ABSTRACT

A retention system for a line on a spool is disclosed. The retention system may include a base component that includes a retention receiving element within a line-side surface of the base component. The retention system may include a line engagement component that includes an engagement surface, wherein the engagement surface includes a portion that is perpendicular to the base component to engage a line, wherein the engagement surface abuts the line-side surface. The retention system may include a removable retention component that is configured to retain the line between the engagement surface and the removable retention component when the removable retention component is installed within the retention receiving element.

15 Claims, 7 Drawing Sheets

(56) References Cited

U.S. PATENT DOCUMENTS 2,421,788 A * 6/1947 Henry ..... B66D 1/34 242/586.1
2,846,162 A * 8/1958 Allin, Sr. ..... B66D 1/34 242/586.1
2,973,941 A * 3/1961 Lunde ..... B66D 1/06 242/388.5
3,069,738 A * 12/1962 Nelson ..... F16G 11/143 294/82.23
3,481,557 A * 12/1969 Miller ..... B66D 1/30 242/395
3,582,011 A * 6/1971 Murray ..... B21C 47/323 242/587.1
3,983,977 A * 10/1976 Crabb ..... B65H 75/406 191/12.4
4,787,602 A * 11/1988 Pidgeon ..... E01F 13/02 114/108
4,832,392 A * 5/1989 Butler ..... B66C 1/12 294/82.12
5,125,628 A * 6/1992 Rempinski ..... B62D 43/045 254/323
5,549,257 A * 8/1996 Sanda ..... B65H 75/28 242/580
5,664,766 A * 9/1997 Baziuk ..... B66D 1/34 254/375
5,779,226 A * 7/1998 Wudtke ..... B63B 21/16 114/293
5,988,095 A * 11/1999 Kallenberger ..... B66D 1/34 114/230.23
6,719,241 B2 * 4/2004 Golden ..... B65H 75/28 242/125.1
6,854,164 B2 * 2/2005 Bass ..... B66B 7/08 24/115 M
6,898,827 B1 * 5/2005 Postelwait ..... F16G 11/046 24/136 L
6,981,670 B2 * 1/2006 Harrington ..... B65H 75/26 242/125.1
7,108,248 B2 * 9/2006 Winter ..... B66D 1/34 242/579
7,226,039 B2 * 6/2007 Sauner ..... B62D 43/045 254/323
7,513,452 B2 * 4/2009 Ruan ..... B66D 1/34 242/125.1
9,067,250 B2 * 6/2015 Halsey ..... B21C 47/045
9,120,656 B2 * 9/2015 Yoder ..... F16G 11/046
9,764,783 B2 * 9/2017 Corral Rodriguez .... B66D 1/34
10,807,841 B2 * 10/2020 Mupende ..... B66D 1/30
10,807,842 B2 * 10/2020 Hall ..... B66D 1/34
10,954,109 B2 * 3/2021 Ijadi-Maghsoodi ..... B66D 1/34
10,988,341 B1 * 4/2021 Curran ..... B66D 1/34
2002/0104918 A1 * 8/2002 Zacharias ..... B66D 1/34 242/587.1
2003/0081986 A1 * 5/2003 Gordon ..... F16C 1/101 403/3
2003/0085391 A1 * 5/2003 Noske ..... B66D 1/30 254/266
2013/0086824 A1 4/2013 Chou et al.
2017/0096793 A1 * 4/2017 Patenaude ..... E02F 3/427
2017/0175359 A1 6/2017 Harnischfeger
2018/0290866 A1 * 10/2018 Mupende ..... F16G 11/00

FOREIGN PATENT DOCUMENTS

JP 10-098825 4/1998
JP 2016-141570 8/2016

* cited by examiner

RETENTION SYSTEM FOR A LINE ON A SPOOL

TECHNICAL FIELD

The present disclosure relates generally to line retention and, for example, to a retention system for a line on a spool.

BACKGROUND

A machine can be used to remove overburden and/or ore during a mining operation. For example, such a machine may include a power shovel with a boom, a dipper handle pivotally connected to a mid-point of the boom, and a shovel bucket (also known as a dipper) pivotally connected to one end of the dipper handle. Cables extend from a hoist drum over a pulley at a distal end of the boom to an end of the dipper handle supporting the dipper. The cables are reeled in or spooled out by electric, hydraulic, and/or mechanical motors connected to the hoist drum to selectively raise and lower the dipper.

Frequently, the cables used with power shovels are steel that have a relatively limited useful lifespan. For example, the cables must be replaced frequently because of limited bending fatigue resistance, due to corrosion (e.g., during use or storage prior to use), and/or the like. Because the cables are heavy and stiff, replacement can be difficult, time consuming, and expensive. In addition, as the cables abrade, strands of the ropes can break and create snag hazards. Further, the cables have a very large bending radius that require large drums and sheaves on the machine.

One approach for a synthetic rope arrangement is disclosed in U.S. Publication No. 2017/0096793 that published on Apr. 6, 2017 ("the '793 reference"). In particular, the '793 reference describes a mounting feature that may be a forged or cast component that is connected at a location of a body (e.g., within a corresponding hole or recess in the body) of a drum. The mounting feature may have a pocket configured to internally receive an end of one or more synthetic rope arrangements for controlling a position of a boom or dipper.

While the synthetic rope arrangement of the '793 reference achieves certain benefits, other benefits are achieved by a line retention system of the present disclosure.

SUMMARY

According to some implementations, a line termination coupling may include a base component having a longitudinal axis and including a retention receiving element within a line-side surface of the base component; a line engagement component that includes an engagement surface, wherein the engagement surface includes a portion that is perpendicular to the base component to engage a line, wherein the engagement surface abuts the line-side surface; and a removable retention component that is configured to retain the line between the engagement surface and the removable retention component when the removable retention component is installed within the retention receiving element.

According to some implementations, a trip spool, for a door of a dipper, may include a drum for coiling or uncoiling a trip line; an end plate attached to an axial end of the drum, wherein the end plate includes: an inner surface, an outer surface opposite the inner surface, and a through hole to enable the trip line to pass through the end plate; and a line termination coupling that includes a hook mechanism to engage an end loop of the trip line, wherein the hook mechanism is attached to the outer surface of the end plate; and a removable retention mechanism to enable the end loop to be installed and retained between the hook mechanism and the retention mechanism.

According to some implementations, a line retention system may include a line connection plate for a spool; a first line retention configuration that is configured to receive a first configuration of a line end; a second line retention configuration that is configured to receive a second configuration of a line end that is different from the first configuration, wherein the first line retention configuration and the second line retention configuration are attached to an outer surface of the line connection plate.

DETAILED DESCRIPTION

Figure 1:
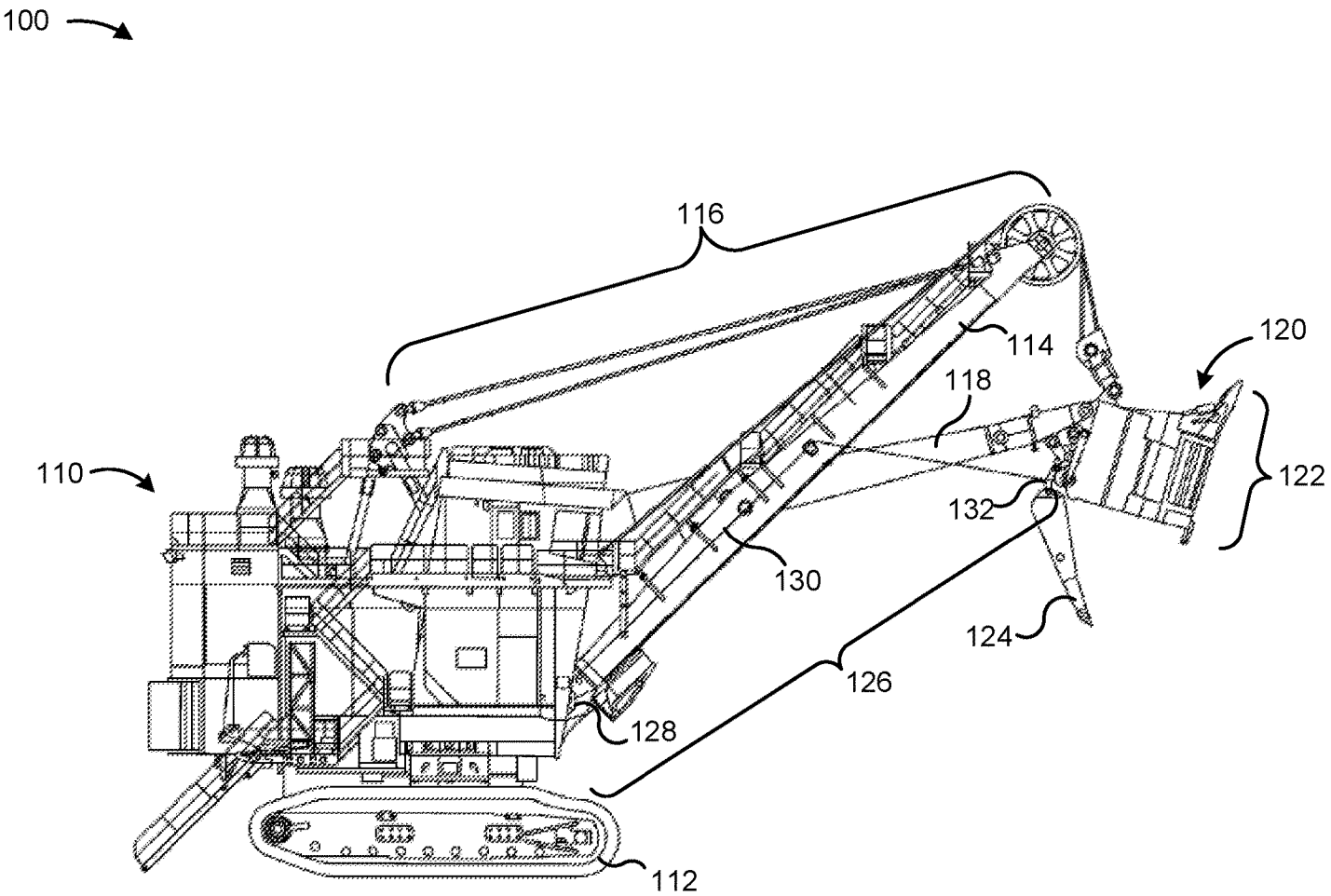
FIG. 1 is a diagram of an example machine described in connection with one or more implementations described herein.

FIG. 1 is a diagram of an example machine 100 described in connection with one or more implementations described herein. The machine 100 is shown in FIG. 1 as a rope shovel (which may also be referred to as a "power shovel"), but may include any type of machine that utilizes a retention system for a line of a spool, as described herein.

The machine 100 includes a frame 110. The frame 110 is configured to mount and/or support various components of the machine 100. The machine 100 includes ground engaging members, such as the tracks 112 coupled to the frame 110. The tracks 112 are configured to propel the machine 100 forward or backward on ground. The tracks 112 are also configured to turn the machine 100 by varying a speed and/or a direction of each of the tracks 112 relative to each other. The frame 110 may also be configured to swing about an axis relative to the tracks 112 to move the machine 100 from a loading position to an unloading position, or vice versa.

The machine 100 includes a boom 114 extending from and coupled to the frame 110, a hoist system 116, and a handle 118 extending from and coupled to a mid-point of the boom 114. The boom 114, hoist system 116, and handle 118 are configured to support a dipper 120 and/or control a position of the dipper 120.

The dipper 120 of the machine 100 includes a body 122 and a door 124 pivotally coupled to the body 122. The dipper 120 is configured to receive material and dump the material based on an operation of the door 124. The machine 100 includes a dipper trip system 126 coupled to the door 124 of the dipper 120. The dipper trip system 126 is configured to operate the door 124. The dipper trip system 126 includes a dipper trip spool 128 and a trip line 130 extending between the dipper trip spool 128 and the door 124. More specifically, the trip line 130 is coupled to a locking mechanism 132 of the door 124. The locking mechanism 132 is configured to selectively lock the door 124 to the body 122 of the dipper 120. The locking mechanism 132 may be any suitable locking mechanism, such as a latch bar, a lever arrangement, and/or the like. Based on an operation of the dipper trip spool 128 (which may be rotatably powered by a motor, such as an electric motor, a hydraulic motor, and/or the like), the trip line 130 retracts and/or actuates the locking mechanism 132. Based on an actuation of the locking mechanism 132, the door 124 is unlocked to dump the material. The dipper trip system 126 may include one or more dipper sensors (not shown) configured to generate a signal indicative of unlocking of the door 124 and/or locking of the door 124.

The dipper trip spool 128 may include a line termination coupling (not shown in FIG. 1), as described herein, to retain (or secure) an end of the trip line 130. In some implementations, the dipper trip spool 128 may include a plurality of line termination couplings to retain different types of trip lines that may serve as trip line 130 (e.g., various trip lines that have a different configurations of line ends, various trip lines made from different materials, and/or the like).

As indicated above, FIG. 1 is provided as an example. Other examples may differ from what is described in connection with FIG. 1.

Figure 2:
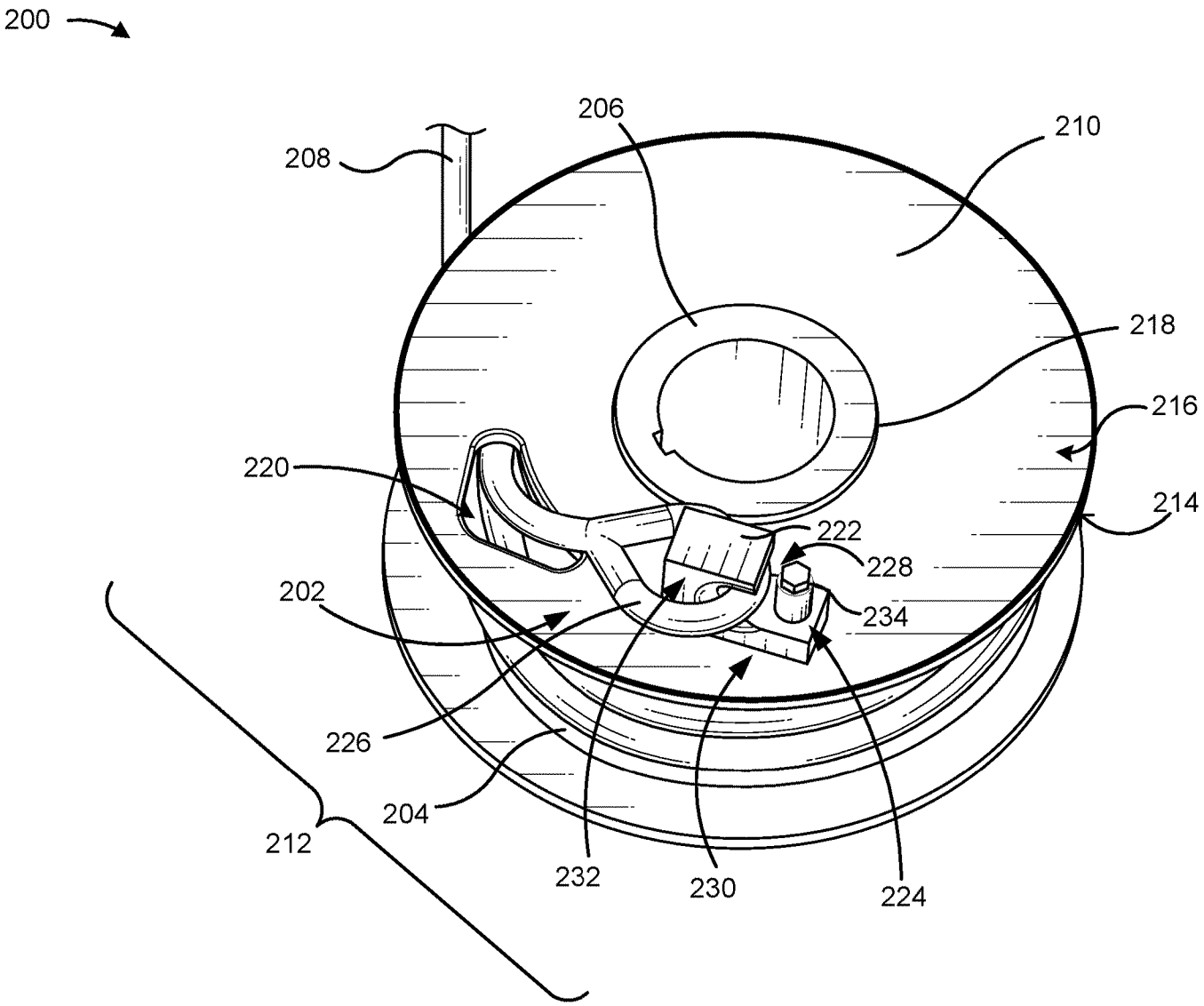
FIG. 2 is a diagram of an example trip spool with an example implementation of a line retention system described herein.

FIG. 2 is a diagram of an example trip spool 200 with an example implementation of a line retention system 202 described herein. The trip spool 200 may correspond to the dipper trip spool 128 described in connection with FIG. 1. The trip spool 200 includes a drum 204. The drum 204 is cylindrical and configured to be mechanically coupled, via a fitting assembly 206, with a motor, which can be controlled to rotate the trip spool 200, and correspondingly spool or unspool a line 208 (which may correspond to trip line 130 of FIG. 1). The drum 204 may be coated with any suitable coating (e.g., a paint, a sealant, and/or the like) to prevent corrosion and/or increase wear resistance on the drum 204 and/or the line 208. Further, the coating may increase a coefficient of friction (e.g., relative to a material of the drum 204) to prevent or reduce movement of the line 208 on the drum 204 and/or reduce a number of coils (or dead wraps) of the line 208 around the drum 204.

As shown, the line retention system 202 includes a line connection plate 210 and a line termination coupling 212 to retain the line 208 (e.g., a line corresponding to trip line 130 of FIG. 1) on the trip spool 200. The line connection plate 210 may serve as an end plate of the trip spool 200 to prevent spooled line from unspooling off an end of the drum 204. The line connection plate 210 includes an inner surface 214 that is on a drum-side of the line connection plate 210 and an outer surface 216 (which is axially opposite the inner surface 214) that is on a line termination-side of the line connection plate 210. Accordingly, the line 208 that is spooled on the drum 204 may abut the inner surface 214. Further, the line 208 may be retained by the line termination coupling 212 on the outer surface 216, as described herein.

As shown, the line connection plate 210 is attached (e.g., press fit, welded, glued, and/or the like) toward a line termination side 218 of the drum 204. In some instances, the line termination side 218 is opposite an axial end of the spool that is adjacent or toward a motor that is configured to drive the trip spool 200. Further, the line termination side 218 may be an axial end of the drum 204 that is accessible when the trip spool 200 is installed and/or mounted to a machine (e.g., machine 100 of FIG. 1) for use.

In FIG. 2, the line connection plate 210 includes a through hole 220 that is an opening between the inner surface 214 and the outer surface 216 of the line connection plate 210. As shown, the through hole 220 is situated relative to the line termination coupling 212 to enable the line 208 to pass through the line connection plate 210 and be engaged with (e.g., in contact with, held in position by, and/or the like) the line termination coupling 212. For example, during installation, the line 208 may be passed through the through hole 220 (e.g., from the line termination-side to the drum-side, or from the drum-side to the line termination-side). The through hole 220 may be any suitable shape and configured or positioned in a manner to reduce tension on a portion of the line 208 (e.g., tension on the line 208 between the through hole 220 and the line termination coupling 212). Further, depending on the material of the line 208, the through hole 220 may be smoothed to have rounded (or beveled) edges, may include a coating, and/or the like (e.g., to prevent fraying or abrasion of the line 208).

As shown in FIG. 2, the line termination coupling 212 includes a hook mechanism 222 and a retention mechanism 224 to engage with and/or retain an end loop 226 at the end of the line 208. The hook mechanism 222 and retention mechanism 224 are positioned relative to one another to form a line retention space 228 between the hook mechanism 222 and the retention mechanism 224.

The hook mechanism 222, as described herein, includes a base component 230 and a line engagement component 232. The base component 230 is attached (e.g., welded, fastened, and/or the like) to the outer surface 216. The line engagement component 232 is to engage end loop 226 of the line 208 to hold the line 208 on the trip spool 200.

The retention mechanism 224 may include a removable retention component 234. For example, the removable retention component 234 may include a removable post, such as a bolt, a dowel, a rivet, a screw, a peg, and/or the like. Correspondingly, the retention mechanism 224 may include a receiving hole (not shown in FIG. 2) in the base component 230 of the hook mechanism 222 that corresponds to the type of removable post (e.g. a threaded hole for a threaded bolt, a fitting hole for a dowel, and/or any other type of retention receiving element). Accordingly, the line retention space 228 may be accessed when the removable retention component 234 of the retention mechanism 224 is not installed to enable the end loop to be installed around the line engagement component 232 of the hook mechanism 222. Correspondingly, the line retention space 228 may be formed (or enclosed) between the hook mechanism 222 and the retention mechanism 224 when the removable retention component 234 of the retention mechanism 224 is installed.

According to some implementations, the line connection plate 210 may include a receiving element, such as a threaded hole, to receive one or more fasteners to fasten the line termination coupling 212 to the line connection plate 210. In some instances, the removable retention component 234 may be one of the fasteners. In such a case, the receiving element may include a through hole that enables the removable retention component 234 to pass through the base component 230 so that the removable retention component 234 can be installed within a receiving element of the line connection plate 210, thereby fastening the line termination coupling 212 to the line connection plate 210.

One or more components (e.g., the base component 230, the line engagement component 232, the removable retention component 234, and/or the like) of the line termination coupling 212 may be covered with a coating to prevent corrosion of the component, improve wear resistance (e.g., of the component and/or the line 208), and/or the like.

In examples described herein, the line 208 may include a synthetic rope formed from any suitable synthetic material (e.g., polypropylene, nylon, polyester, polyethylene, aramid, and/or the like). The line 208 may have certain specifications for certain applications. For example, as a trip line (similar to the trip line 130), the line 208 may have particular stretch characteristics to reduce or prevent stretch (and improve responsiveness with respect to unlocking the door 124), durability characteristics to improve a lifespan of the line 208, and/or the like. Additionally, or alternatively, the line 208 may be any other suitable material (e.g., a steel cable) that is configured with a loop to permit engagement with line termination coupling 212.

As indicated above, FIG. 2 is provided as an example. Other examples may differ from what is described in connection with FIG. 2.

Figure 3B:
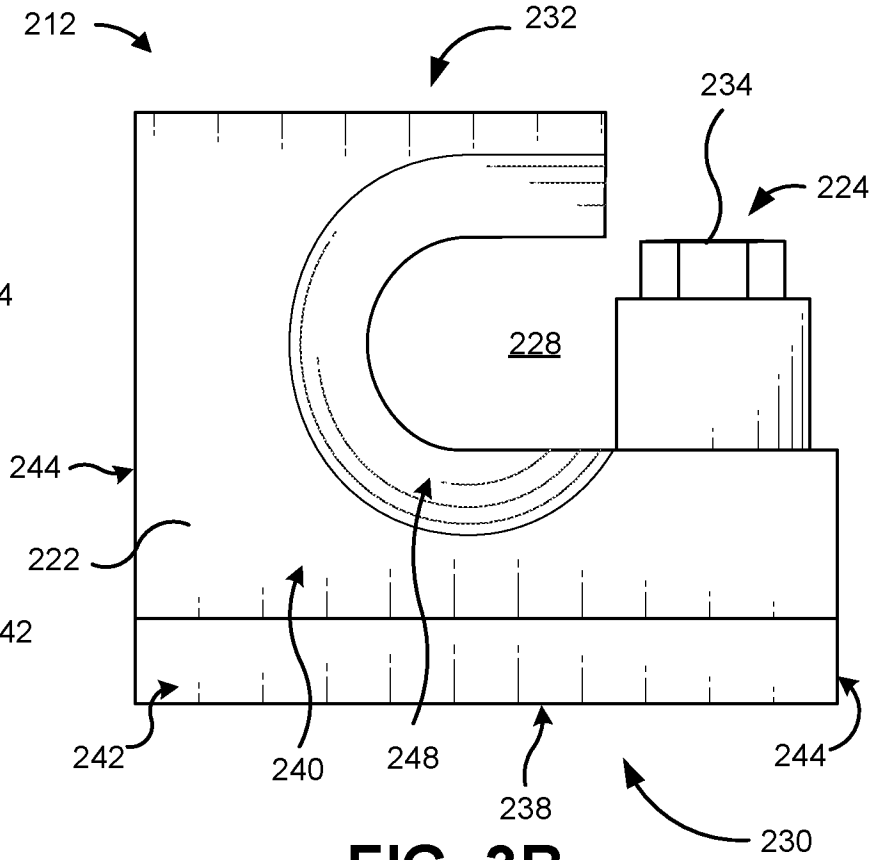
FIG. 3B is a plan view of an example implementation of a line termination coupling that may be implemented in the line retention system of FIG. 2.
Figure 3A:
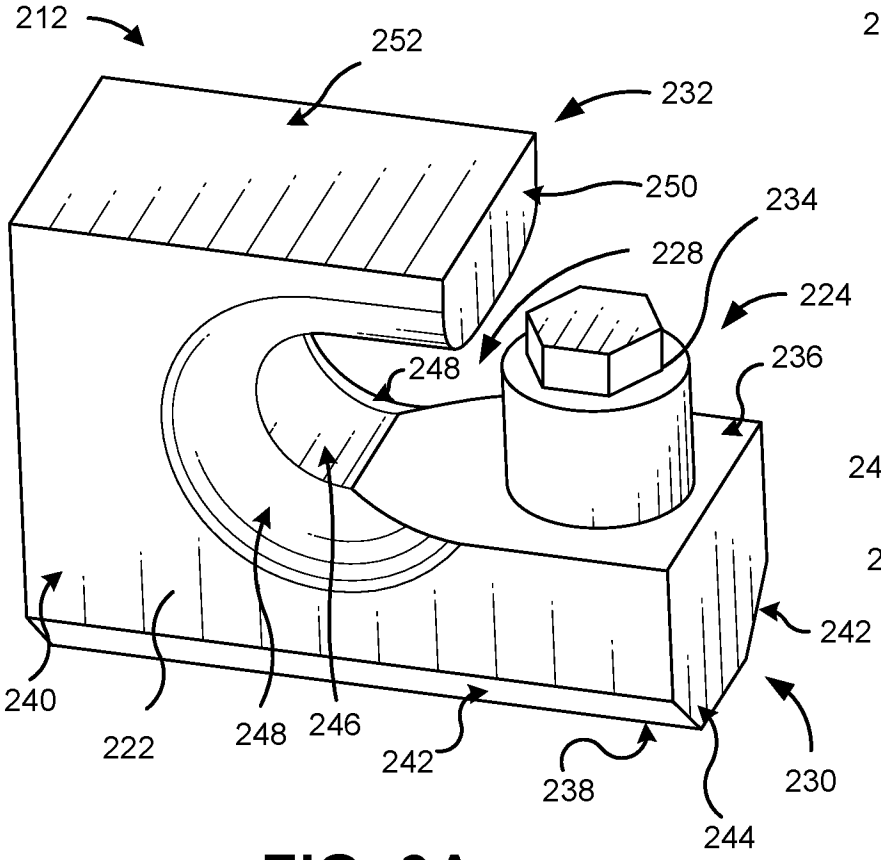
FIG. 3A is an isometric view of an example implementation of a line termination coupling that may be implemented in the line retention system of FIG. 2.
Figure 3D:
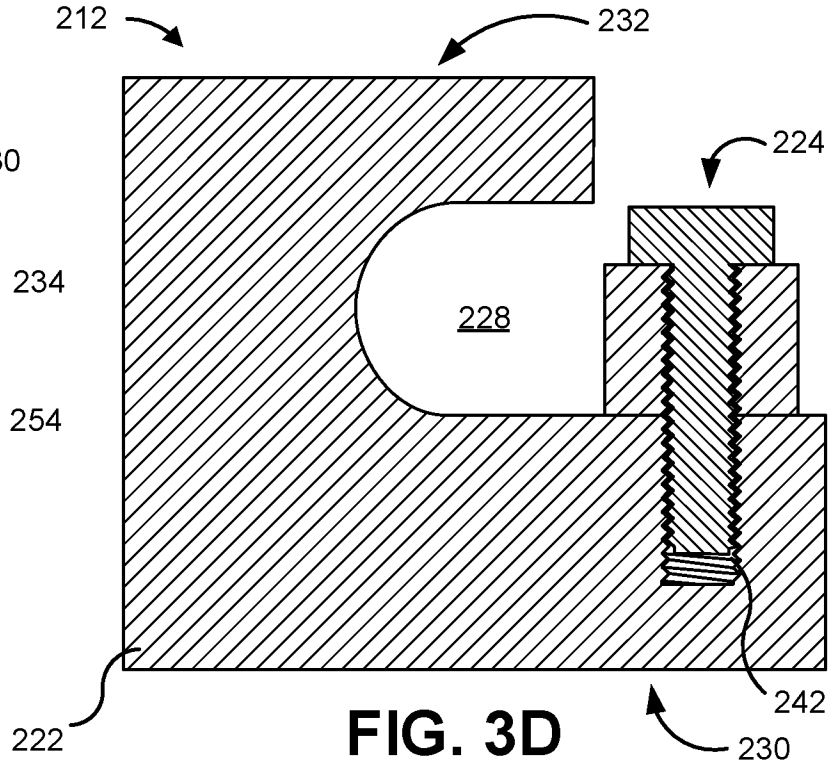
FIG. 3D is a cross-sectional view of an example implementation of a line termination coupling that may be implemented in the line retention system of FIG. 2.
Figure 3C:
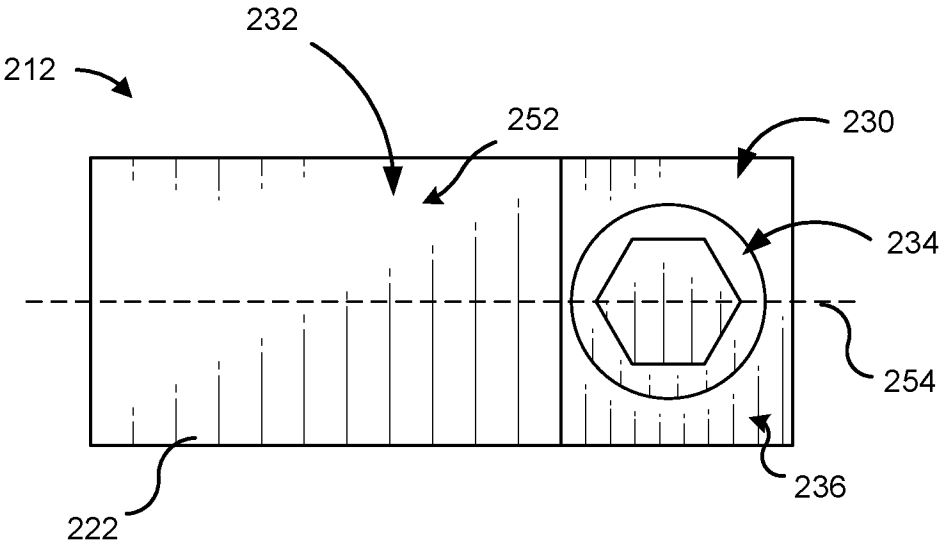
FIG. 3C is a top view of an example implementation of a line termination coupling that may be implemented in the line retention system of FIG. 2.
Figure 3E:
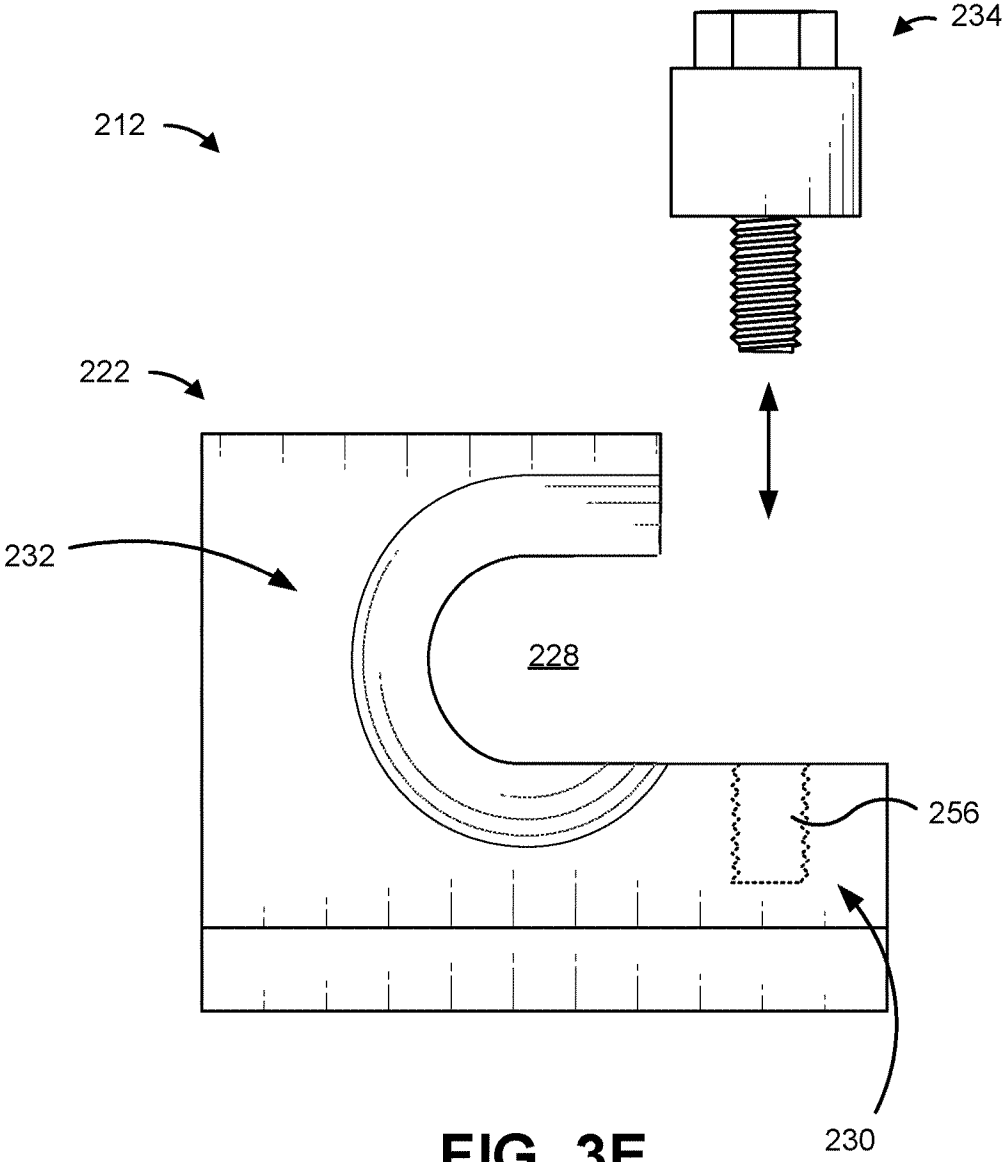
FIG. 3E is a plan view of an example implementation of the line termination coupling of FIGS. 3A-3D.

FIGS. 3A-3E are diagrams of an example implementation of the line termination coupling 212 that may be implemented in the line retention system 202 of FIG. 2. As shown, FIG. 3A is an isometric view of the line termination coupling 212, FIG. 3B is a plan view of the line termination coupling 212, FIG. 3C is a top view of the line termination coupling 212, and FIG. 3D is a cross-sectional view of the line termination coupling 212. FIG. 3E is an example implementation of the line termination coupling 212 with the removable retention component 234 of the retention mechanism 224 uninstalled. The line termination coupling 212 of FIGS. 3A-3E may correspond to the line termination coupling 212 of FIG. 2. Accordingly, reference numbers for components in FIGS. 3A-3E may refer to corresponding components of the line termination coupling 212 in FIG. 2. Though every component of line termination coupling 212 is not identified with reference numbers in each of FIGS. 3A-3E, the components are identified to suitably illustrate the relationship of the components of the line termination coupling 212.

As shown in FIGS. 3A-3E, the hook mechanism 222 includes a base component 230 and a line engagement component 232. The base component 230 corresponds to the portion of the hook mechanism 222 that is to be attached to the line connection plate 210 and is to receive the removable retention component 234 to retain the line 208. The base component 230 has a line-side surface 236, a plate-side surface 238, lateral side surfaces 240, beveled base surfaces 242, and longitudinal end surfaces 244. The line-side surface 236 (e.g., a least a base portion of the line-side surface 236) and the plate-side surface 238 are opposite one another and run parallel to one another (e.g., within a threshold angle of being parallel corresponding to a manufacturing tolerance or machining tolerance).

The beveled base surfaces 242 abut the plate-side surface 238 and the lateral side surfaces 240. The beveled base surfaces 242 may be any suitable size and/or shape to improve and/or facilitate attaching the line termination coupling 212 to the line connection plate 210 via welding so that the plate-side surface 238 abuts the line connection plate 210 (e.g., the outer surface 216 of the line connection plate). The lateral side surfaces 240 are shown as relatively flat and perpendicular (e.g., within a threshold angle of being perpendicular corresponding to a manufacturing tolerance or machining tolerance) to the line-side surface 236 and the plate-side surface 238. The lateral side surfaces 240 may extend to and/or correspond to side surfaces of the line engagement component 232.

The line engagement component 232 corresponds to the portion of the hook mechanism 222 that extends from the base component 230 and/or that is to primarily engage with the line 208 (e.g., when the line 208 is within the line retention space 228 and pulled tightly through the through hole 220). The line engagement component 232 has the lateral side surfaces 240, an engagement surface 246, rounded edge surfaces 248, a hook end surface 250, and a top surface 252. As shown, the engagement surface 246 has a semicircular surface that abuts the line-side surface 236 to extend from the base component 230 and form a hook structure (e.g., a J-shaped hook). As shown, the rounded edge surfaces 248 abut the engagement surface 246 (and/or the line-side surface) and the lateral side surfaces 240. The rounded edge surfaces 248 may be formed to prevent fraying and/or abrasion of the line 208 (e.g., due to being pulled tightly around the drum 204) when installed within the line retention space 228. Correspondingly, a portion of the engagement surface 246 (e.g., corresponding to a tangent of the semicircular surface) may be perpendicular to the line-side surface 236. The radius of the semicircular surface of the engagement surface 246 may correspond to a radius (e.g., may be the same as and/or within a threshold percentage) of the line 208 so that the line 208 fits within the line retention space 228.

The hook mechanism 222 of FIGS. 3A-3E may be formed of a single type of material (e.g., a same metal or a same metal alloy, such as steel). Additionally, or alternatively, the line termination coupling 212 may be formed from a single piece of material. The line termination coupling 212 may be stamped, laser cut, flame cut, water cut, machined (e.g., grinded, polished, tapped, and/or the like) and/or the like from a piece of steel. Additionally, or alternatively, the line termination coupling 212 may be formed using a mold (e.g., by pouring molten material into the mold and allowing the molten material to cool in the form of the line termination coupling 212). Correspondingly, the base component 230 and the line engagement component 232 of the hook mechanism 222 may be formed as a single component from a same material or a single piece of material.

In FIG. 3D, the cross-sectional view of the line termination coupling 212 is shown as being cut along a bisecting longitudinal plane 254 of the line termination coupling 212. As shown in FIGS. 3D and 3E, a retention receiving element 256 of the retention mechanism 224 is a threaded opening in the line-side surface 236 of the base component 230. The retention receiving element 256 is configured to receive the removable retention component 234 to retain the line 208 between the engagement surface 246 and the removable retention component 234. In some implementations, the retention receiving element 256 may correspond to a through hole that passes through the line-side surface 236 to the plate-side surface (e.g., to permit the removable retention component 234 to be installed within a receiving element of the line connection plate 210, if equipped).

In FIGS. 3A-3E, the removable retention component 234 is shown as a fastener (e.g., a threaded bolt) and a spacer. In such a configuration, the spacer is configured to receive the fastener and fit between a head of the fastener (or "fastener end") and the line-side surface 236 to provide support for the fastener, ease installation of the fastener, and/or further enclose the line retention space 228. The removable retention component 234, when installed, may be perpendicular to the line-side surface 236 and extend from the base component 230 to form the line retention space 228. Correspondingly, the removable retention component 234 may extend a distance from the line-side surface 236 that is equal to or greater than inner dimensions of the hook mechanism (e.g., a diameter of the semicircular surface of the engagement surface 246). Accordingly, when installed in the retention receiving element 256, the removable retention component 234 is configured to retain the line between the engagement surface 246 and the removable retention component 234. As shown in FIG. 3E, the removable retention component 234 can be uninstalled from the hook mechanism 222 to enable the line 208 to be removed from the line retention space 228.

As indicated above, FIGS. 3A-3E are provided as one or more examples. Other examples may differ from what is described in connection with FIGS. 3A-3E. For example, the size, shape, surface structure, and/or the like of the line retention system of FIGS. 3A-3E may vary with respect to what is illustrated in FIGS. 3A-3E.

Figure 4:
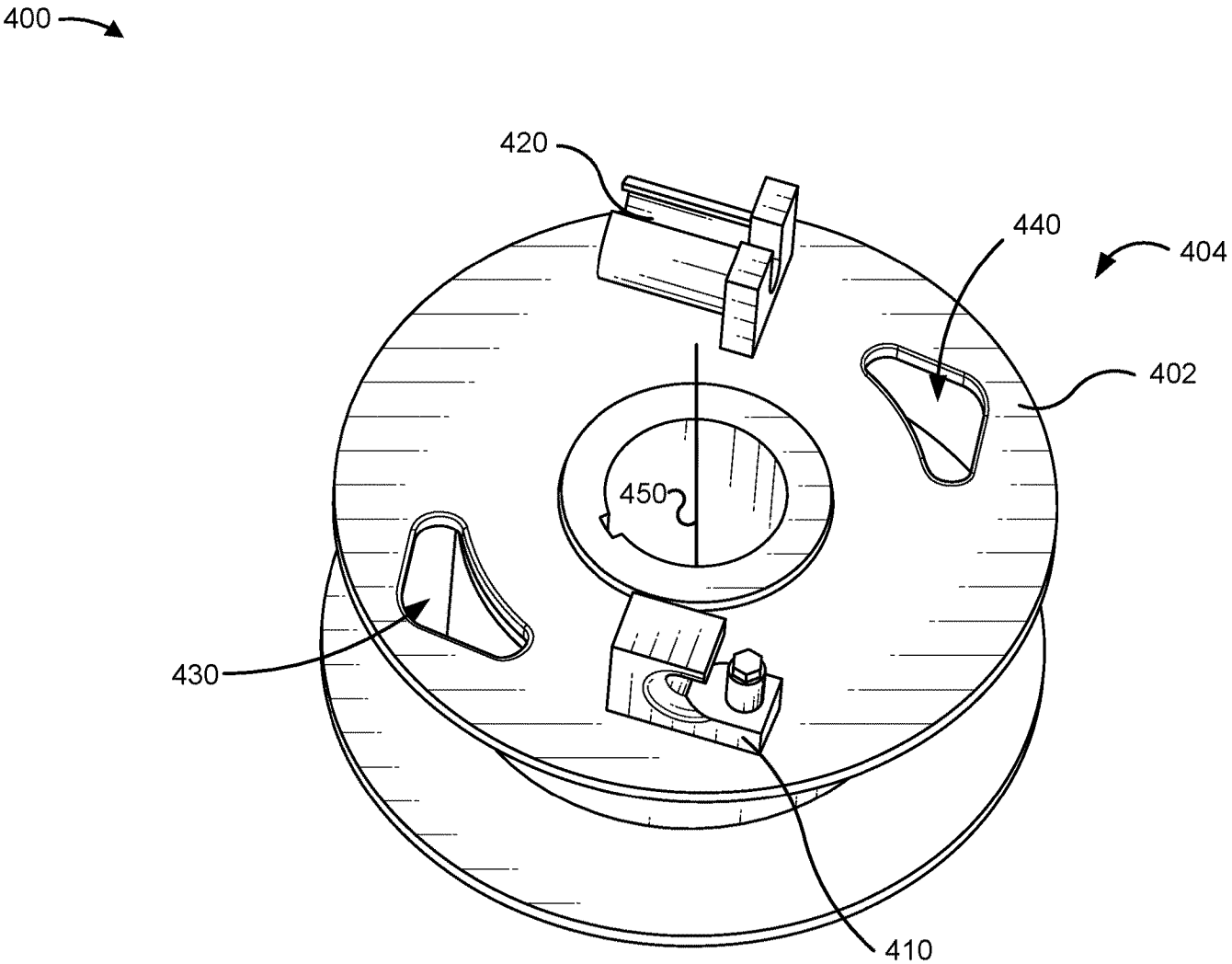
FIG. 4 is a diagram of an example line retention system described herein.

FIG. 4 is a diagram of an example line retention system 400 described herein. The line retention system 400 includes two different line retention configurations on a line connection plate 402 (e.g., an outer surface of the line connection plate 402) of a spool 404. The line connection plate 402 may correspond to the line connection plate 210 and/or the spool may correspond to the trip spool 200.

A first line retention configuration of line retention system 400 (e.g., which may correspond to line termination coupling 212) includes a hook mechanism 410 (e.g., corresponding to the hook mechanism 222), and a second line retention configuration includes a crimped end receiver 420. As shown, the hook mechanism 410 is situated near a first through hole 430 and the crimped end receiver 420 is situated near a second through hole 440, through which a line may pass to engage with either the hook mechanism 410 or the crimped end receiver 420. As shown, the hook mechanism 410 is situated opposite the crimped end receiver 420 relative to a rotational axis 450 of the spool (e.g., to equally distribute the first through hole 430 and the second through hole 440 to facilitate structural integrity of line connection plate 402). For other example implementations including more than two line retention configurations, the corresponding line retention configurations may correspondingly be equally distributed around the rotational axis 450.

Accordingly, the line retention system 400 is configured to receive and/or be compatible with two different types of configurations of a line. As indicated above, FIG. 4 is provided as an example. Other examples may differ from what is described in connection with FIG. 4.

Figure 5B:
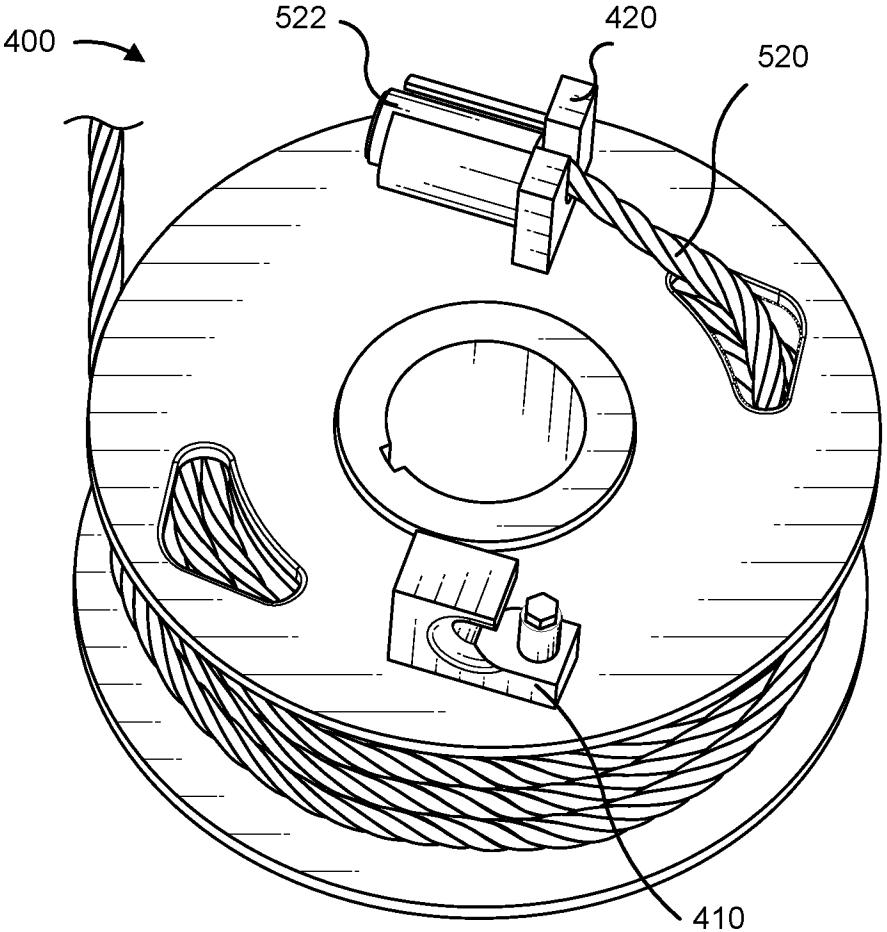
FIGS. 5A and 5B are diagrams of example implementations of the line retention system of FIG. 4.
Figure 5A:
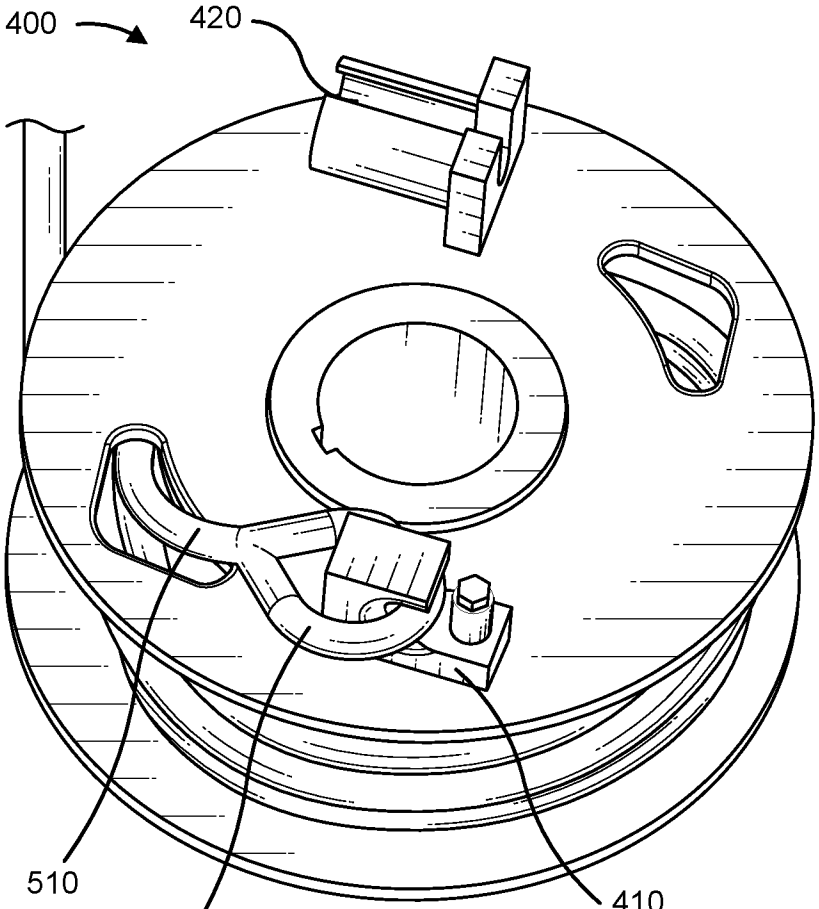

FIGS. 5A and 5B are diagrams of example implementations of the line retention system 400 of FIG. 4. As shown in FIGS. 5A and 5B, the line retention system 400 is configured to receive two different types of configurations of a line. As shown in FIG. 5A, a line 510 includes a loop 512 that is capable of engaging with the hook mechanism 410, as described herein. The line 510 in FIG. 5A may be a synthetic rope or a steel cable.

As shown in FIG. 5B, a line 520 (which is separate from the line 510) includes a crimped end component 522 that is capable of being received within the crimped end receiver 420. The line 520 in FIG. 5B may be a steel cable that is capable of receiving and retaining crimped end component 522.

Accordingly, as shown, the line retention system 400 is capable of receiving and retaining two different configurations of line. As indicated above, FIGS. 5A and 5B are provided as one or more examples. Other examples may differ from what is described in connection with FIGS. 5A and 5B.

INDUSTRIAL APPLICABILITY

The disclosed line retention system may be used in any construction machine application where component longevity, reliability, cost, and ease of use are desired. The disclosed line retention system allows for use with synthetic rope, which may have a relatively longer useful life than other types of line, such as a steel cable with a crimped end component. The line retention system, as described herein, may extend a life span of a synthetic rope by reducing friction on the synthetic rope (e.g., via rounded engagement surfaces on a hook mechanism, rounded edges of through holes in a line connection plate, positioning of through holes relative to the hook mechanism, coatings, and/or the like). Further, the life span of the synthetic rope can be extended by preventing damage to the rope during installation because the line retention system eases installation of the synthetic rope (e.g., the line simply needs to be fed through the through hole and placed into a line retention space of the hook mechanism).

More specifically, the line retention system is configured to enable a synthetic rope to have a life span that corresponds to a period of a maintenance cycle for a machine that includes the line retention system, as described herein. Accordingly, scheduled replacement of a line utilizing the line retention system, described herein, can be aligned with a maintenance schedule for other components of the machine (e.g., the engine, the ground engaging elements, an operator station, and/or the like) to prevent unexpected downtime due to failure of the line. Such failures can result in damage to the machine and/or an implement of the machine, can cause safety concerns, and/or the like. Further, unexpected downtime can incur relatively high costs that depend on the length of the downtime. Moreover, to facilitate maintenance associated with the line retention system (e.g., to replace the line, to repair the spool, to install or replace the line retention system, and/or the like), the line retention system may be positioned on an axial end of a spool that is accessible when the spool is installed and/or mounted to a machine (e.g., machine 100 of FIG. 1) for use. Enabling use of synthetic rope, which is lighter and more flexible than steel cable, can also reduce cost and hassle associated with replacing a damaged or used line.

A hook mechanism of a line retention system, described herein, is configured to withstand relatively high amounts of force applied by an installed line (e.g., using relatively flat outer surfaces) while maintaining durability of the installed line (e.g., via rounded surfaces on an inner portion of the hook). Further, as described herein, the line retention system is configured to be formed from and/or utilize readily available materials (e.g., pieces of metal or metal alloys that can be used to form the hook mechanism) and components (e.g., fasteners, spacers, and/or the like to form the retention mechanism). In this way, the hook mechanism can be formed and/or produced with relatively low amounts of design resources (only material types and/or sizes of components need to be determined according to line dimensions and/or expected applied force) and relatively low manufacturing complexity (line retention mechanism can be assembled from independently created parts when ready to be installed for use), thereby reducing costs and hardware resource consumption.

Further, the line retention system, as described herein, can be universally added to existing components (e.g. spools, pulleys, and/or the like) of a machine. For example, an end plate of an existing trip spool of a dipper can be replaced by a line retention system described herein (e.g., a line connection plate with a hook mechanism and retention mechanism), thereby enabling an existing dipper that was previously configured to utilize a steel cable to be able to easily use a line with an end loop. Additionally, or alternatively, a hook mechanism and retention mechanism described herein can relatively easily be attached (e.g., through welding, fastening, and/or the like) to an existing end plate of the trip spool to enable the dipper to utilize a line with an end loop.

According to some implementations described herein, an example implementation of a line retention system, may be configured to utilize multiple, different configurations of a line. For example, a line retention system, as described herein, may be compatible with a line that includes an end loop or a crimped end component. Accordingly, a single part can be used with multiple different types of line. Correspondingly, the line retention system described herein can be utilized with more varieties of readily available line, including synthetic rope, steel cable, and/or the like.

As used herein, the articles "a" and "an" are intended to include one or more items and may be used interchangeably with "one or more." Also, as used herein, the terms "has," "have," "having," or the like are intended to be open-ended terms. Further, the phrase "based on" is intended to mean "based, at least in part, on."

Some implementations are described herein to include a parallel relationship or a perpendicular relationship. As used herein, parallel is meant to cover substantially parallel and perpendicular is meant to cover substantially perpendicular. Further, as used herein, "substantially" refers to a described measurement, element, or relationship being within a tolerance (e.g., a design tolerance, a manufacturing tolerance, an industry standard tolerance, and/or the like).

The foregoing disclosure provides illustration and description but is not intended to be exhaustive or to limit the implementations to the precise form disclosed. Modifications and variations may be made in light of the above disclosure or may be acquired from practice of the implementations. It is intended that the specification be considered as an example only, with a true scope of the disclosure being indicated by the following claims and their equivalents. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

What is claimed is:

1. A line termination coupling comprising:

a base component having that includes a retention receiving element within a line-side surface of the base component;

a line engagement component that includes an engagement surface, wherein the engagement surface includes a portion that is perpendicular to the base component to engage an end portion of a line, wherein the engagement surface abuts the line-side surface, wherein the line engagement component comprises a hook structure, and wherein the hook structure is formed from the engagement surface including a semicircular surface that abuts the line-side surface; and a removable retention component that is configured to retain the end portion of the line between the engagement surface and the removable retention component when the removable retention component is installed within the retention receiving element, wherein the hook structure includes:

a set of rounded edge surfaces; and a set of lateral side surfaces, wherein rounded edge surfaces, of the set of rounded edge surfaces, abut the semicircular surface and corresponding lateral side surfaces of the set of lateral side surfaces.

2. The line termination coupling of claim 1, wherein the retention receiving element includes a threaded hole to receive a bolt of the removable retention component to retain the end portion of the line between the engagement surface and the removable retention component.

3. The line termination coupling of claim 1, wherein a radius of the semicircular surface of the engagement surface corresponds to a radius of the end portion of the line when the end portion of the line is retained between the engagement surface and the removable retention component when the removable retention component is installed within the retention receiving element.

4. The line termination coupling of claim 1, wherein the removable retention component, when installed, extends a distance from the line-side surface that is greater than or equal to a diameter of the semicircular surface.

5. The line termination coupling of claim 1, wherein the base component and the line engagement component are a single component formed from a same material.

6. The line termination coupling of claim 1, wherein the removable retention component includes:

a fastener that is to be received within the retention receiving element, and a spacer that is to fit between a fastener end of the fastener and the line-side surface.

7. The line termination coupling of claim 6, wherein the fastener is perpendicular to the line-side surface of the base component.

8. The line termination coupling of claim 1, wherein the removable retention component includes a threaded bolt that, when uninstalled, enables the end portion of the line to be removed from the line termination coupling when the removable retention component is not installed within the retention receiving element.

9. A trip spool for a door of a dipper, the trip spool comprising:

a drum for spooling or unspooling a trip line;

an end plate attached to an axial end of the drum, wherein the end plate includes:

an inner surface, an outer surface opposite the inner surface, and a through hole to enable the trip line to pass through the end plate; and a line termination coupling comprising:

a hook mechanism to engage an end loop of the trip line, wherein the hook mechanism is attached to the outer surface of the end plate; and a retention mechanism to enable the end loop to be installed and retained between the hook mechanism and the retention mechanism, wherein the retention mechanism comprises:

a threaded bolt, and a threaded hole in a base of the hook mechanism.

10. The trip spool of claim 9, wherein the hook mechanism includes a line-side surface and a plate-side surface that is opposite a base portion of the line-side surface, wherein the plate-side surface abuts the outer surface of the end plate.

11. The trip spool of claim 10, wherein the hook mechanism includes:

lateral side surfaces that are perpendicular to the line-side surface, and a rounded edge surface that abuts the lateral side surfaces and the line-side surface to reduce abrasion of the end loop.

12. The trip spool of claim 9, wherein a plate-side surface of the hook mechanism is welded to the outer surface of the end plate.

13. A line retention system comprising:

a line connection plate for a spool;

a first line retention configuration that is configured to receive a first configuration of a line end, wherein the first configuration of the line end includes a loop and the first line retention configuration includes a hook mechanism; and a second line retention configuration that is configured to receive a second configuration of a line end that is different from the first configuration, wherein the second configuration of the line end includes a crimped end component and the second line retention configuration includes a crimped end receiver configured to receive the crimped end component, wherein the first line retention configuration and the second line retention configuration are attached to an outer surface of the line connection plate, and wherein the line connection plate includes a first through hole associated with the first line retention configuration and a second through hole that is associated with the second line retention configuration.

14. The line retention system of claim 13, wherein the outer surface is opposite an inner surface of the line connection plate that is adjacent a drum of the spool.

15. The line retention system of claim 13, wherein the first line retention configuration is opposite the second line retention configuration on the line connection plate relative to a rotational axis of the spool.

* * * * *